US005697875A

United States Patent [19]

Stan

[11] Patent Number: 5,697,875

[45] Date of Patent: Dec. 16, 1997

[54] COLLAPSIBLE HIGH-LOW PUSH UP EXERCISER

[76] Inventor: William Stan, 202 Lamplight La., Lewisburg, Pa. 17837

[21] Appl. No.: 720,313

[22] Filed: Sep. 27, 1996

Related U.S. Application Data

[63] Continuation of Ser. No. 543,394, Oct. 16, 1995, abandoned.

[51] Int. Cl.[6] ..... A63B 26/00; A63B 1/00

[52] U.S. Cl. ..... 482/141; 482/38; 482/42

[56] References Cited

U.S. PATENT DOCUMENTS 2,817,522 12/1957 Margolies ..... 482/38

3,289,992 12/1966 Brooks ..... 248/220.31

3,642,278 2/1972 Hinckley ..... 482/38

*Primary Examiner*—Lynne A. Reichard

*Attorney, Agent, or Firm*—Carothers & Carothers

[57] ABSTRACT

A collapsible push up exercise device having hinged flared sides which, when opened for use, form an inverted V-shape. A plurality of spaced holes are provided on the front sides of the hinged framework for the reception at selective heights of hook-like extensions of two partially closed rings which rings encircle and support a push up bar.

2 Claims, 2 Drawing Sheets

COLLAPSIBLE HIGH-LOW PUSH UP EXERCISER

CROSS-REFERENCE TO RELATED APPLICATIONS

This is a file wrapper continuation application for prior application Ser. No. 08/543,394, filed on Oct. 16, 1995 now abandoned in the name of William Stan for COLLAPSIBLE HIGH-LOW PUSH UP EXERCISER.

This application is an improvement of my application filed May 5, 1995, Ser. No. 08/435,543 for High-Low Push Up Exerciser now abandoned.

This invention relates to a collapsible exercise device for performing push-ups at selective heights.

BACKGROUND OF THE INVENTION

The present application is for a modification of the High-Low Push Up Exerciser to make it collapsible, thereby saving storage and shipping space.

Additionally, the present application changes the means of attaching the push-up bar to the framework of the exercise device by eliminating the system of hooks or notches on the framework of the push up device.

In addition, this change in the means of attaching the push up bar to the framework eliminates a potential safety hazard, should a person come in contact with support flanges on a framework.

SUMMARY OF THE INVENTION

This invention relates to a collapsible push up exercise device which uses a push up bar encircled by two partially closed rings with hook-like extensions, which extensions insert into one pair of selectively located holes, which holes are placed in the front support sides of exercise device. The attachment of the push up bar to the framework of the device could also be accomplished by replacing the partially closed rings with pins with hook-like ends. The pins would be welded to the push up bar and the hook-like end would be inserted into one of a pair of selectively located holes situated in the front support sides of the framework.

DESCRIPTION OF PREFERRED EMBODIMENTS

Figure 1:
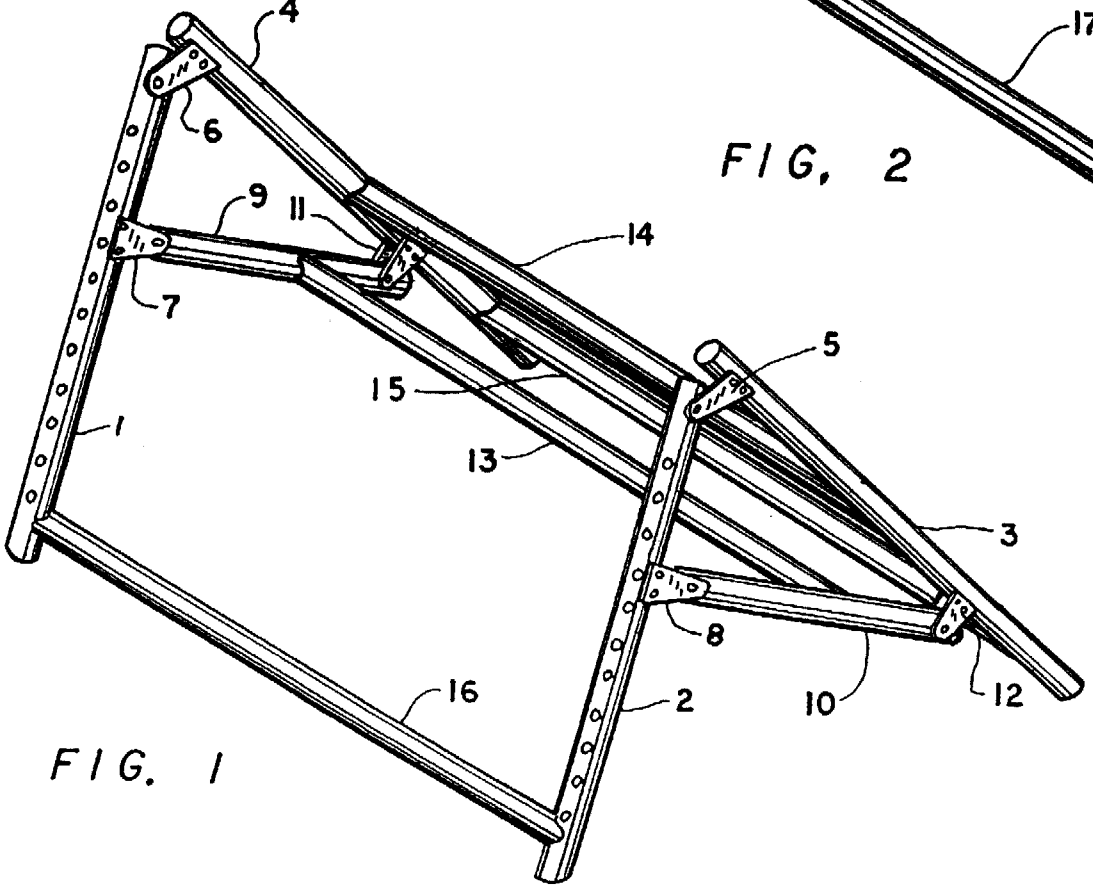
FIG. 1 is a front perspective view which shows a hinged, collapsible framework with a plurality of selectively positioned holes along the front sides of the framework.

FIG. 1 is a front perspective view which shows a hinged, collapsible framework having sides 1,4 and 2,3 of inverted V-shape, preferably of round or squared tubular metal, with front vertical legs 1 and 2 having a plurality of evenly spaced holes for the insertion of hook-like extensions 20–21 of partially closed rings, (FIG. 2) said hook-like extensions thereby providing support for a transverse push up bar 17. Hinges 5 and 6 are permanently secured to the top of back vertical legs 3 and 4, which legs form the back side of the inverted V-shape framework.

Unsecured ends of hinges 5 and 6 are bolted to the tops of front legs 1 and 2 of framework. Hinges 7 and 8 are permanently secured to the front legs 1 and 2 at an approximate mid-point on said legs. This arrangement provides two side frames 1,4 and 2,3 respectively hinged together at their upper ends by hinges 6 and 5, thereby each providing a collapsible inverted "V" shaped framework when hinged open. Unsecured ends of hinges 7 and 8 are attached to frame cross braces 9 and 10 with a removable pin. Hinges 11 and 12 are permanently secured to back legs 3 and 4 at a point approximately one third of the distance from the bottom of the legs 3 and 4. Unsecured ends of hinges 11 and 12 are attached to frame cross braces 9 and 10, said braces secured between front legs 1,4 and back legs 2,3. Brace 13 is secured between frame cross braces 9 and 10. Side cross braces 14 and 15 are secured between side frames 1,4 and 2,3. Side cross brace 16 is secured between side frames 1,4 and 2,3 close to the bottom of front legs 1 and 2.

Figure 2:
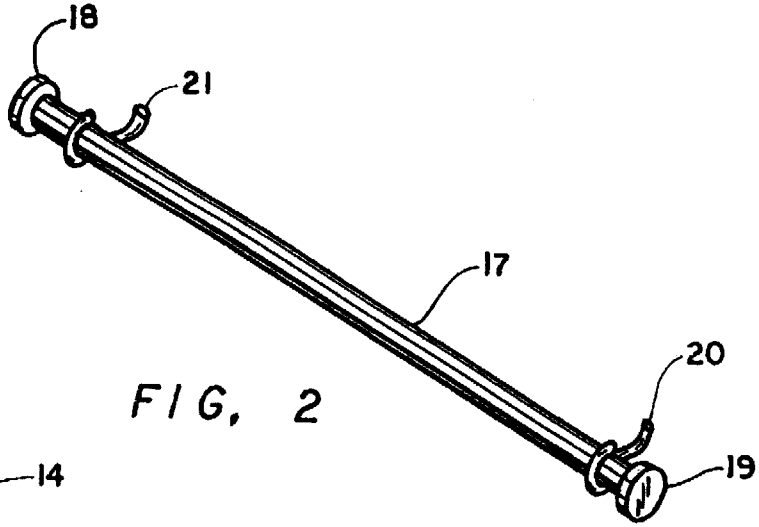
FIG. 2 is a perspective view which shows a removable push up bar encircled by two partially closed rings having hook-shaped extensions.

FIG. 2 is a perspective view which shows a transverse push up bar, 17, constructed perferably of steel tubing, and having end integral washers, 18 and 19, and two partially closed rings with hook-like extensions, 20 and 21.

Figure 3:
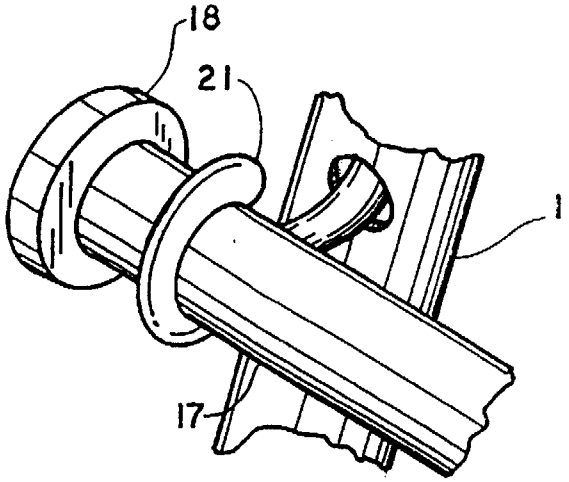
FIG. 3 is a perspective view which shows an enlargement of a portion of the front section of the hinged collapsible framework, showing one hole, and the push up bar as it is positioned in one of the partially closed rings with a hook-shaped extension, showing how the extension would be positioned into the shown hole of the frame.

FIG. 3 is a perspective view which shows a cutaway section of a hole on front side 1 or 2, the ringed push up bar 17, and the hook-like extension of partially closed ring 20 or 21, as it is positioned in the hole on front leg 1 or 2.

Figure 4:
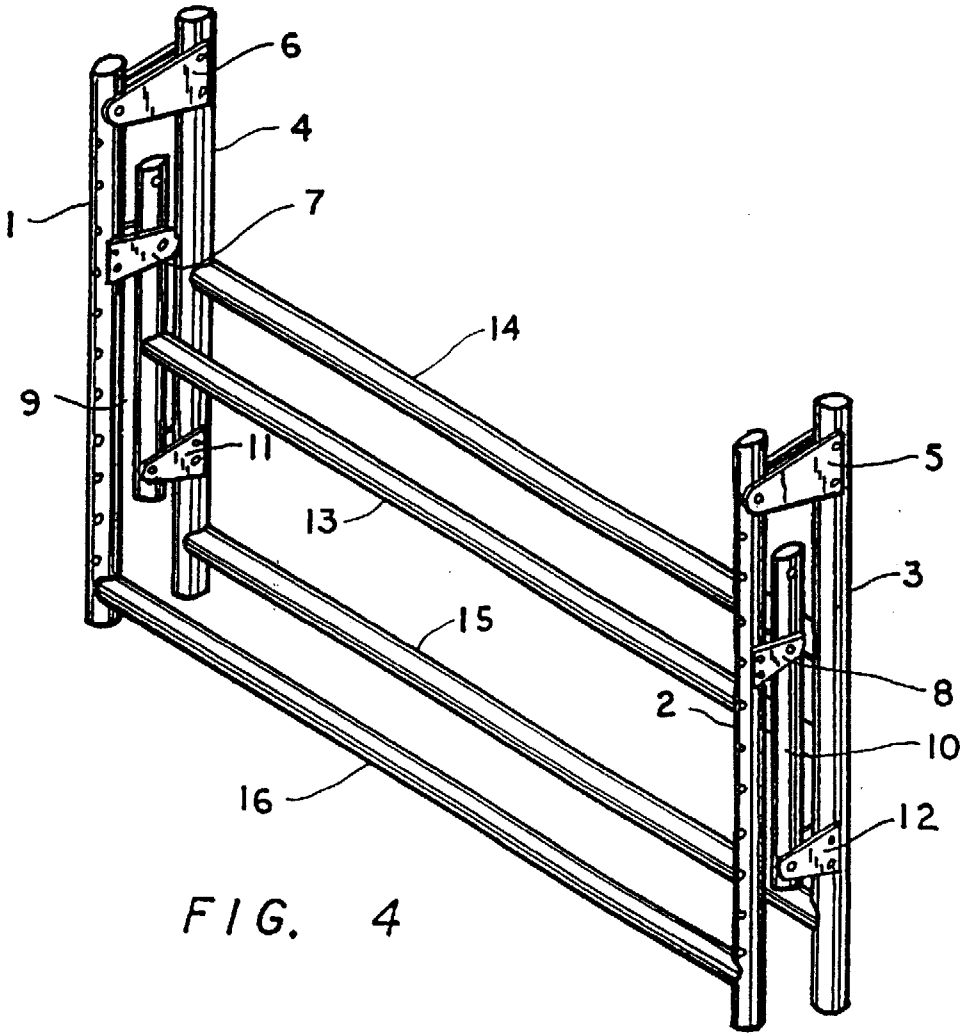
FIG. 4 is a front, perspective view which shows the hinged push up exercise device in collapsed condition.

FIG. 4 is a perspective view which shows the collapsed form of the hinged framework of the push up device.

I claim:

1. A collapsible exercise device for performing pushups at selected heights, said device comprising: two side flames having upper and lower ends and hinged together at their upper ends for thereby providing a collapsible inverted "V" shaped framework when hinged open, frame cross braces hingedly connecting said side frames together below said upper hinges for bracing said framework in said inverted "V" shaped open configuration and for permitting said side frames to be hinged together for collapsible storage, a transverse pushup bar adapted for vertical adjustable securement between said side frames on one side of said framework for providing a cross bar on said framework for grasping and thereby performing pushups at preselected vertical bar heights on said framework, said side frames including vertical legs connected with side cross braces, said side cross braces positioned below said upper hinges without any additional side cross braces provided above said pushup bar whereby all space between said side frames and above said pushup bar is clear for providing head clearance when performing pushups.

2. The collapsible exercise device of claim 1, including a series of spaced holes in said vertical legs on said one side and hook extensions on said pushup bar for engaging said holes and thereby adjustably securing said bar to said one side of said framework.

* * * * *